US005829110A

United States Patent [19]

Kashihara

[11] Patent Number: 5,829,110

[45] Date of Patent: Nov. 3, 1998

[54] APPARATUS FOR TYING WIRE HARNESS

[75] Inventor: Masatoshi Kashihara, Toyonaka, Japan

[73] Assignee: Japan Solderless Terminal Mfg. Co., Ltd., Osaka, Japan

[21] Appl. No.: 871,549

[22] Filed: Jun. 9, 1997

Related U.S. Application Data

[62] Division of Ser. No. 718,721, Sep. 24, 1996.

[30] Foreign Application Priority Data

Oct. 5, 1995 [JP] Japan ..... 7-284628

[51] Int. Cl.[6] ..... H01R 43/00

[52] U.S. Cl. ..... 29/33 F; 29/755; 140/93 A

[58] Field of Search ..... 29/33 F, 33 M, 29/564.7, 564.8, 755, 748, 564.4, 564.6; 53/591; 242/439; 156/486; 140/93 A, 93.2

[56] References Cited

U.S. PATENT DOCUMENTS

| | | | |
|---|---|---|---|
| 3,891,012 | 6/1975 | Bakermans | 140/93 A |
| 4,077,118 | 3/1978 | McKeever | 29/748 |
| 4,114,014 | 9/1978 | Shogo et al. | 29/564.4 |
| 4,705,080 | 11/1987 | Hanscom | 140/93 A |
| 5,355,787 | 10/1994 | Burns et al. | 156/486 |
| 5,365,659 | 11/1994 | Veda et al. | 29/755 X |
| 5,732,457 | 3/1998 | Ishiwata et al. | 29/564.7 |
| 5,740,608 | 4/1998 | Long | 29/33 F X |

*Primary Examiner*—William R. Briggs
*Attorney, Agent, or Firm*—Antonelli, Terry, Stout & Kraus, LLP

[57] ABSTRACT

Improvement in connection to an automatic crimper (6) which operates in the known manner to divide leads (1) into groups (1*a*,1*b*,1*c*, etc.), before crimping one ends of the leads to branching connectors (2) and crimping the other ends of all the leads to a common connector (3) so as to form a multiple harness (4). Subsequently, the crimper drives the branching connectors to travel in parallel and in unison with the common connector along a pair of delivery rails (7) until discharged from the rails. The improvement resides in that the branching connectors (2) are caused to take a position close to the common connector (3) so that leads in each group are folded double, then the leads are gathered to form a compact bundle (1') before being tied with tapes (5) which serve as an easily breakable binding material.

4 Claims, 16 Drawing Sheets

APPARATUS FOR TYING WIRE HARNESS

This application is a Divisional application of application Ser. No. 08/718,721, filed Sep. 24, 1996.

FIELD OF THE INVENTION

The present invention relates to a multiple harness tied up into a bundle, a method of and an apparatus for tying the harness, wherein a plurality of leads constituting the harness are divided into groups and have one ends fixed to a common connector and other ends fixed to respective branching connectors each belonging to one of the groups.

In general, the leads are of different lengths between the groups. The number of such branching connectors crimped to the lead ends of one multiple harness varies. The number of terminals forming each branching connector or forming the common connector will also vary from product to product. Thus, the term 'multiple harness' used herein is intended to inclusively refer to such a variety of harnesses.

DESCRIPTION OF PRIOR ART

Electronic devices and apparatuses have been and are becoming sophisticated more and more in their structure, and the quantity of signals processed by them is increasing. Therefore, electric circuits built in those devices have terminals to be connected to each other by a number of leads. For this purpose, multiple harnesses are used which comprise a number of connectors crimped on the ends of the leads. Automatic crimpers have been improved to produce sophisticated multiple harnesses. However, the more complicated in configuration the harnesses, the more likely to become tangled are their leads. Usually, the leads in multiple harnesses are untangled manually after manufacture and before use.

Workers attending the automatic crimpers must manually bind the leads up into a bundle, to prevent them from tangling. Rubber bands or tapes are used to tie the harnesses one by one, or several ones at a time, before delivered from the crimpers. Due to such a labor costing work, any worker cannot be cast in charge of more than two crimpers. It has been almost impossible to run the crimpers in a full automatic or unattended manner. Even if the automatic crimper itself is of a high performance, its actual capacity will depend on the efficiency of the workers' manual operations.

SUMMARY OF THE INVENTION

An object of the present invention is therefore to provide not only a multiple harness tied up into a bundle, but also a method of and apparatus for tying the multiple harness. The harnesses delivered from an automatic crimper have to be tied into compact bundles not tending to tangle with each other. The multiple harnesses thus tied into the bundles should facilitate the post-treatment thereof. The method of and the apparatus for tying said harnesses should be so designed that the binding of leads of each harness may be carried out automatically to enable the crimper to operate in a full automatic and unattended manner.

A multiple harness tied up into a bundle in accordance with the present invention must comprise: leads divided into a plurality of groups; a number of branching connectors, the number being the same as the number of the groups; a common connector; one ends of the leads included in each group being connected to one of branching connectors; the other ends of all the leads being connected to the common connector; the branching connectors and the common connector being positioned close to each other; and an easily breakable and elongate binding material, wherein the leads are folded double and tied with the binding material such that the branching connectors and the common connector are positioned close to each other. The binding material used herein may be of such a moderate strength as to be torn off readily with a user's hands, or may have any indents or some rows of fine perforations such as made using a sewing machine. The same applies to other modes of the present invention described below.

A method proposed herein is designed to tie a multiple harness delivered from an automatic crimper, in which crimper a plurality of leads are divided into at least two groups, then one ends of the leads of the groups are crimped and fixed to respective branching connectors, the other ends of all the leads are crimped and fixed to a common connector to thereby form a multiple harness, and finally the branching connectors are driven along one of delivery rails so as to travel in parallel and in unison with the common connector which is traveling along the other delivery rail paired with the one rail and disposed in the automatic crimper, so that the harness is discharged from the crimper. The method proposed herein must comprise the steps of: causing the branching connectors to take a position close to the common connector so that each lead is folded double; and then gathering and tying all the doubled leads with an easily breakable and elongate binding material.

An apparatus proposed herein is designed to tie a multiple harness delivered from an automatic crimper and to accompany the automatic crimper, in which crimper a plurality of leads are divided into at least two groups, then one ends of the leads of the groups are crimped and fixed to respective branching connectors, the other ends of all the leads are crimped and fixed to a common connector to thereby form a multiple harness, and finally the branching connectors are driven along one of delivery rails so as to travel in parallel and in unison with the common connector which is traveling along the other delivery rail paired with the one rail and disposed in the automatic crimper, so that the harness is discharged from the crimper. The apparatus provided herein must comprise: a pair of supporters disposed adjacent to ends of the delivery rails so as to respectively support the branching connectors and the common connector of each multiple harness; a driving means for causing the supporters to reciprocate between a first position aligned with the delivery rails and receiving therefrom the branching and the common connectors attached to the harness and a second position where the supporters are held close to each other so that the leads are folded double; a binding means for gathering and tying the folded leads into a bundle with portions of an easily breakable and elongate binding material; and a cutting means for severing the portions from a remainder of the binding material.

DETAILED DESCRIPTION OF THE PREFERRED EMBODIMENTS

Figure 1:
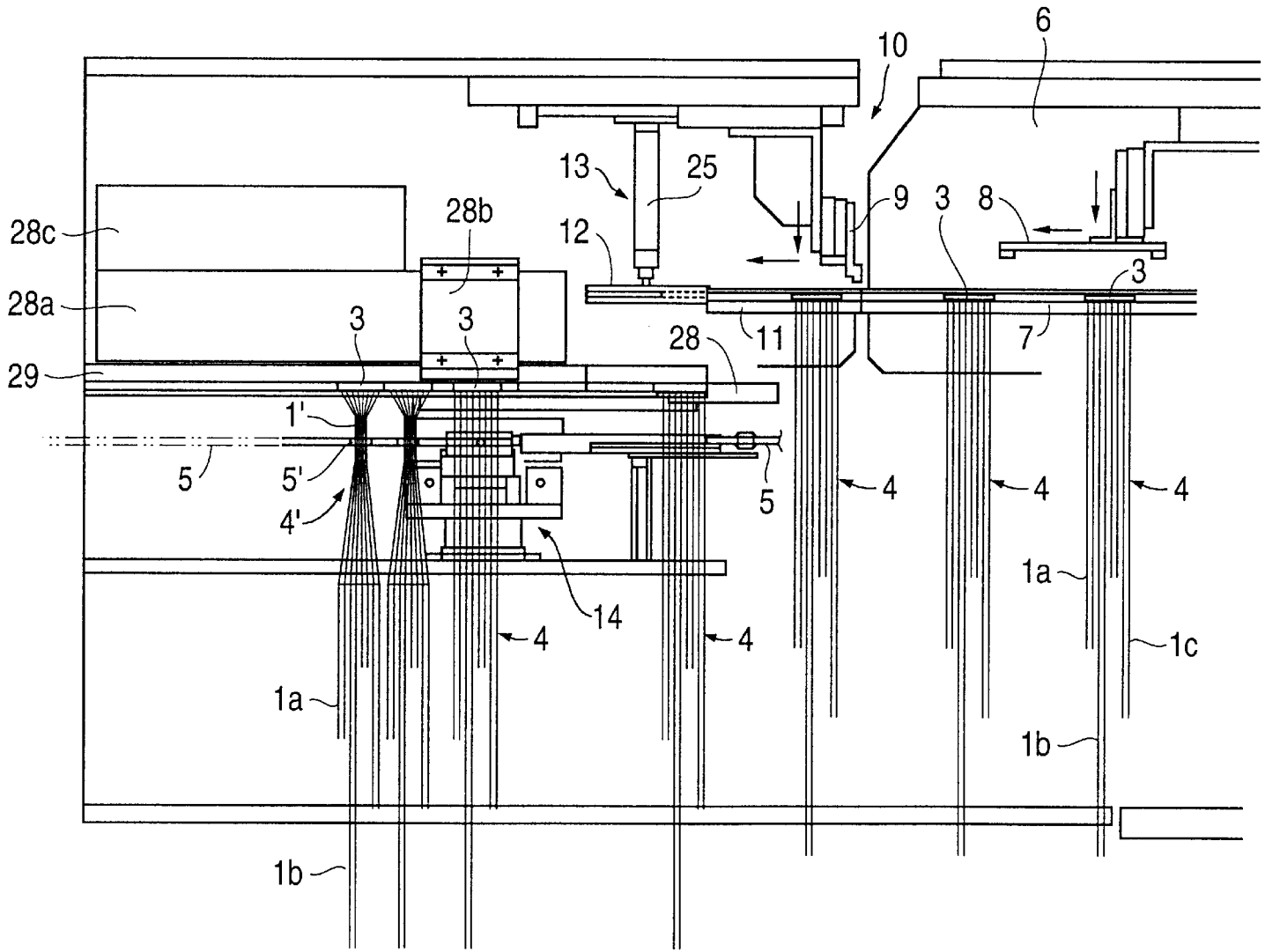
FIG. 1 is a front elevation of an apparatus provided in an embodiment for binding a multiple harness, with some portions being cut off.

Some embodiments of the invention will now be described referring to the drawings.

Figure 2:
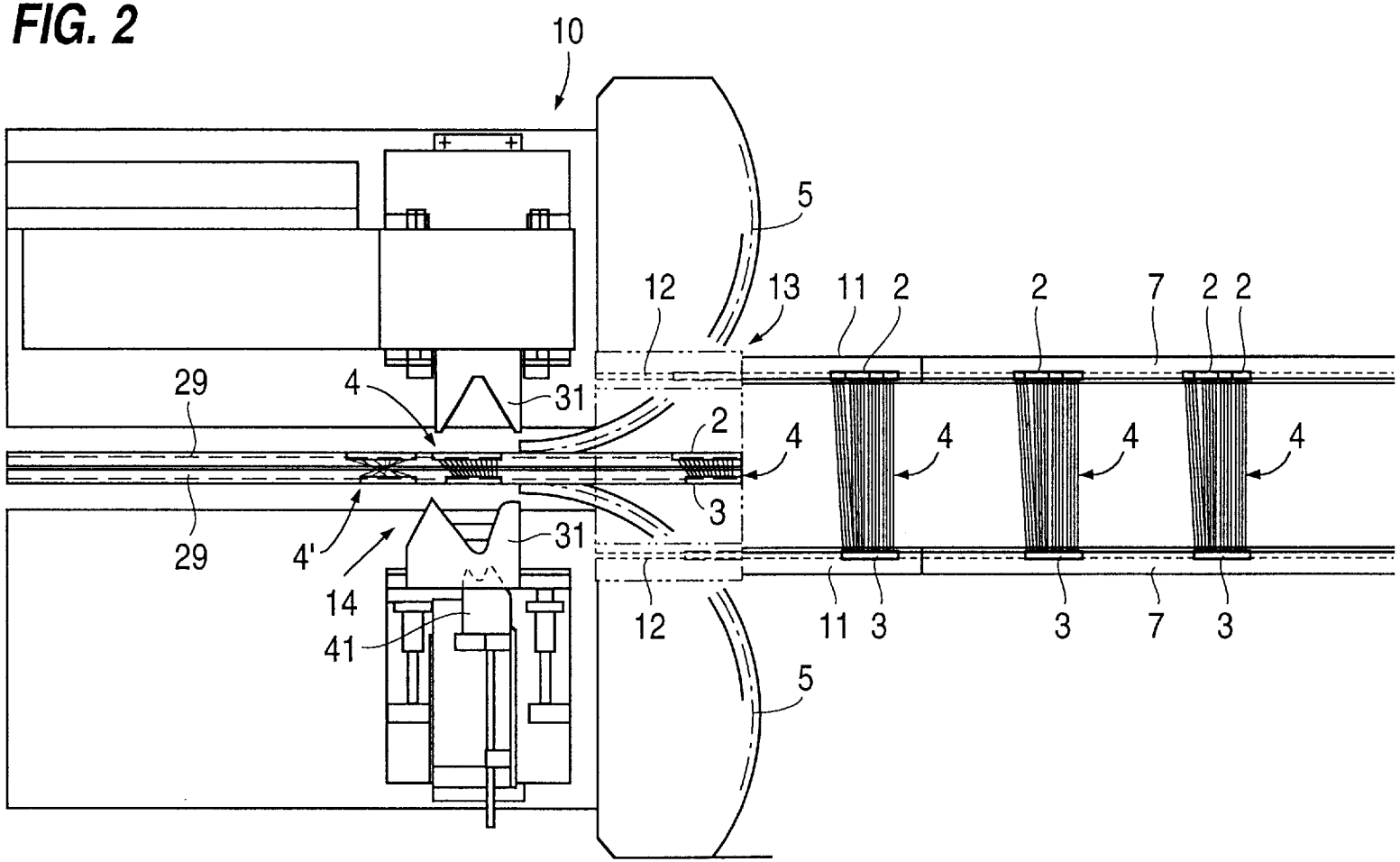
FIG. 2 is a plan view of a principal part of the apparatus shown in FIG. 1.
Figure 3:
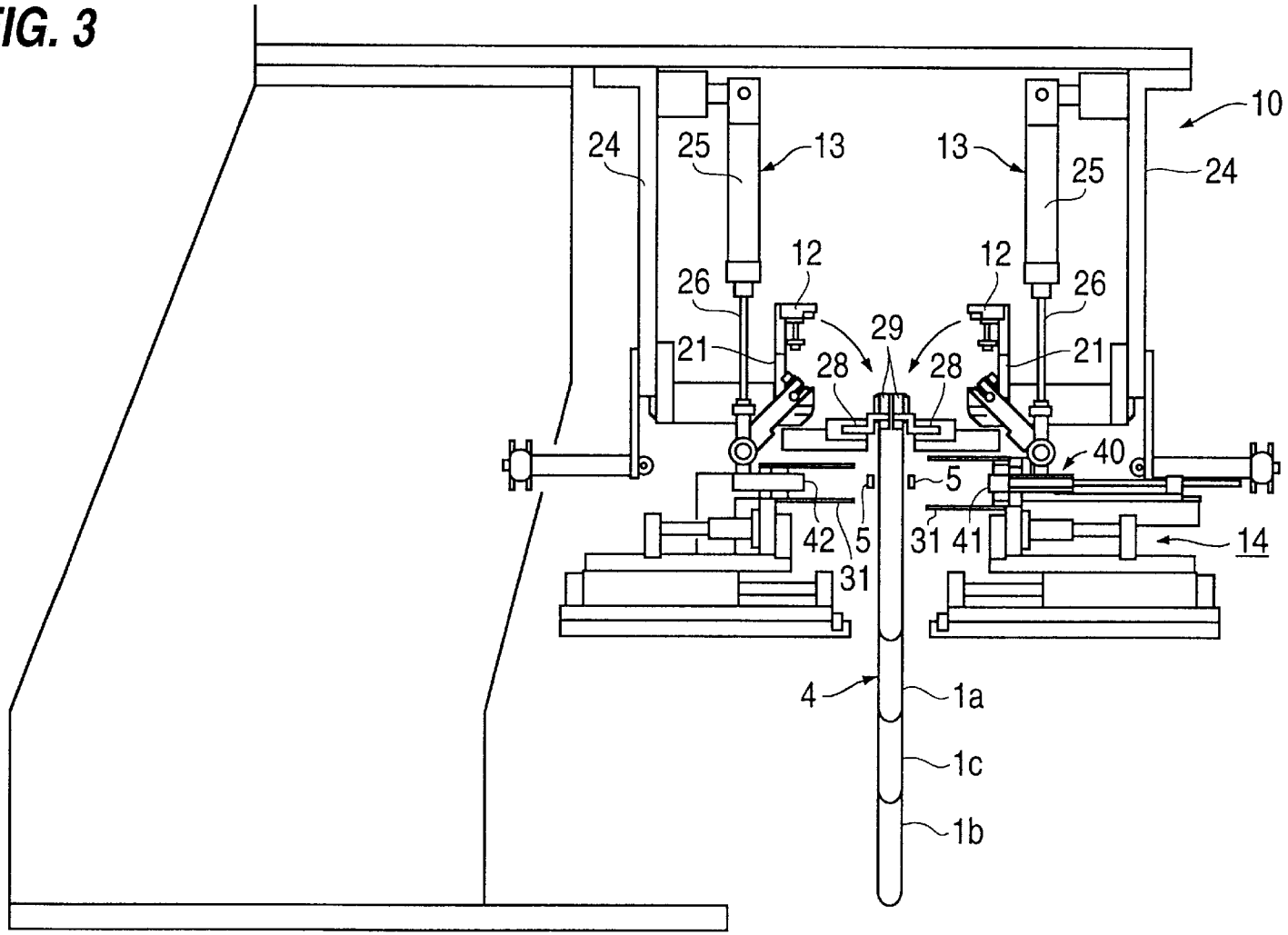
FIG. 3 is a left-hand side elevation of the principal part.

FIGS. 1 to 3 show an embodiment in which an apparatus for tying multiple harnesses is arranged in line with an automatic crimper. This crimper accompanied by the apparatus of the invention produces the multiple harnesses each comprising a plurality of leads. A body 6 of the automatic crimper consists of some devices not shown but including feeders for supplying the connectors and the leads. At a crimping station in the crimper, the leads 1 will be divided at first into a few or several groups 1*a*, 1*b*, 1*c*, etc. of different lead lengths as shown in the drawings. One ends of the leads 1 belonging to each group will then be crimped to one of branching connectors 2. The other ends of all the leads are crimped to a common connector 3 to form each harness 4. This crimper allows any variation in length of the leads included in the groups 1*a* etc., any variation in the number of branching connectors 2, and any variation in the number of terminals in each branching connector 2 and/or common connector 3.

The multiple harnesses 4 thus produced will then transfer onto a pair of delivery rails 7 disposed at an exit of the crimper body 6. One of the rails supports the branching connectors 2, whilst the other rail 7 supports the common connector 3 of each harness. A pawl device 8 intermittently drives those harnesses 4 to be discharged one by one from the exit.

A tying apparatus 10 of the invention comprises a pair of guide rails 11. The guide rails are aligned with the delivery rails 7 and smoothly continue from the ends thereof. The apparatus 10 further comprises a pair of supporters 12 disposed adjacent to ends of the guide rails 11. A driving means 13 drives the supporters 12 to reciprocate between a first position and a second position. At the first position, the supporters 12 will be aligned with the delivery rails 7 so as to receive and hold the harness at the connectors attached thereto. At the second position, the supporters 12 will lie close to each other so that all the leads 1*a*, 1*b*, 1*c*, etc. are folded double. A binding means 14 will gather tightly the folded leads 1*a*, etc. at their portions near the connectors, after the harness 4 has transferred to this means 14 from the supporters 12. During and after such a transfer, the branching connectors 2 will be kept at their position located near the common connector 3. Subsequently, the binding means 14 operates to tie the leads 1*a*, etc. into a bundle with portions of paired tapes 5 that are being arranged properly to serve as a whole as the easily breakable and elongate binding material. A cutting means 15 (see FIGS. 11 and 12) will then sever the tape portions adjoined to the leads from remainders of the tapes 5. The tapes may preferably be such paper tapes that are fusion bondable and manually tearable easily with hands. Any binding materials of the other kinds can be used insofar as it is readily torn off.

Figure 4:
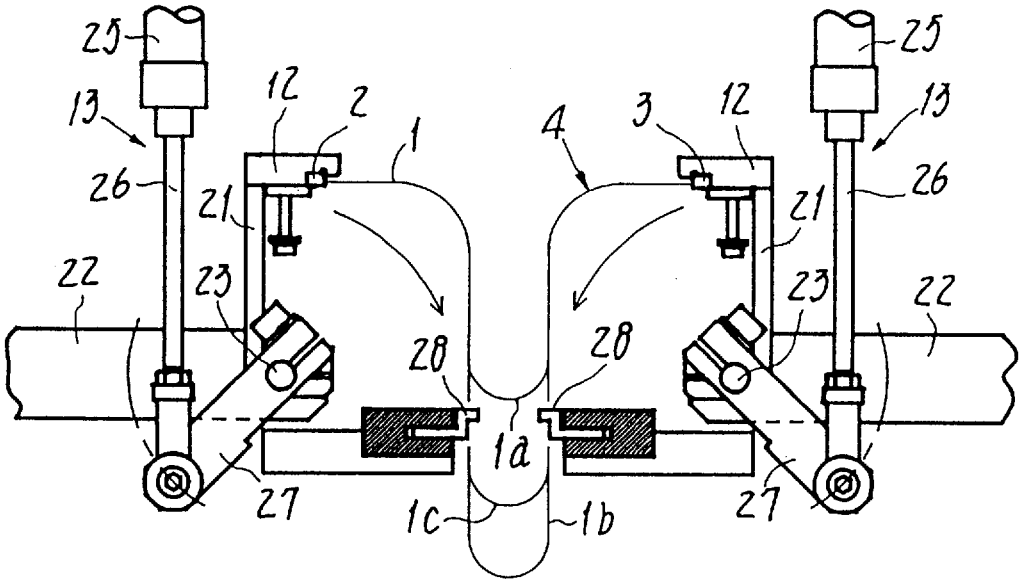
FIG. 4 is a front elevation of a pair of supporters for connectors, the supporters being held temporarily at a first position by a driving mechanism.
Figure 5:
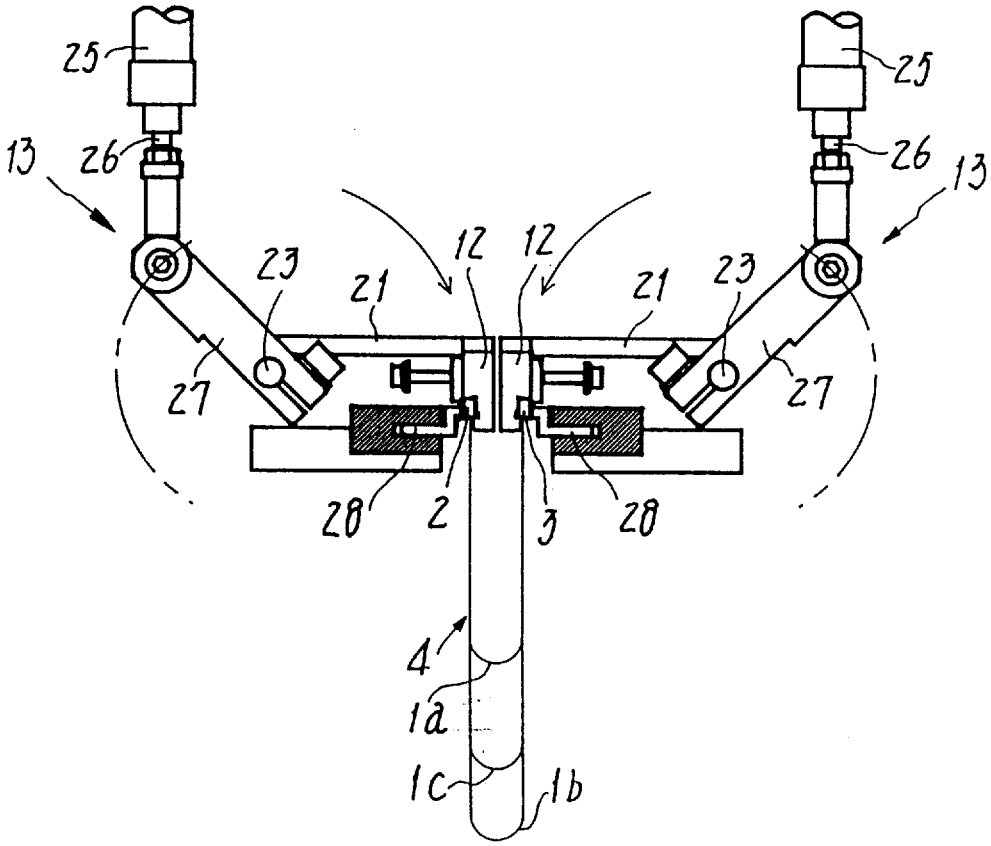
FIG. 5 is also a front elevation similar to FIG. 4, but showing the supporters at a second position.

As seen in FIGS. 3 to 5, the supporters 12 respectively have grooves formed therein so as to receive and temporarily hold the branching connectors 2 or common connector 3. To this end, a further pawl device 9 ( see FIG. 1) transfers those connectors from the guide rails 11 to said grooves. Arms 21 are fixedly secured to the sides of said supporters 12 and rotatably connected by pivots 23 to respective base plates 22. The supporters can thus swing an angle of 90° degrees, towards and away from each other, so that their first position in FIG. 4 (for receiving the connectors) and their second position in FIG. 5 will alternate under control.

Figure 15:
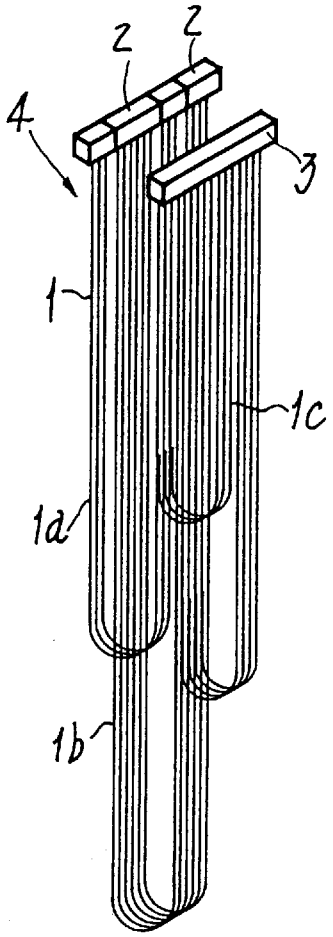
FIG. 15 is a perspective view similar to FIG. 14, but showing the harness in its state ready for binding.

The driving means 13 for swinging the supporters 12 comprises props 24 (FIG. 3). Pneumatic cylinders 25 having piston rods 26 are connected to the respective props. The means 13 further comprises rocking links 27, wherein each link 27 has one end pivoted to the piston rod 26. The other end of the link 27 is fixed on the pivot 23 so as not to rotate relative to each other. The supporters 12 are driven by said means 13 to take the second position where they are juxtaposed to each other. As a consequence, the leads belonging to the groups 1*a*, 1*b*, 1*c*, etc. in the multiple harness 4 will be folded double to be ready for the tying, as seen in FIG. 15. Subsequently, a pair of further pawls 28 facing one another push the branching and common connectors 2 and 3 into the next guide rails 29 (see FIGS. 1 and 2). Thus, the harness and its connectors will advance to a binding station where the binding means 14 is disposed. FIG. 1 shows that the further pawls are fixed on sliders 28*b* that are in a sliding engagement with a guide plate 28*a*. A servo motor 28*c* driving the sliders along the guide rails 29 is controlled such that the connectors 2 and 3 of the harness 4 can stay at the binding station for a given time before advancing to a discharging station.

As will be seen in FIGS. 6 to 12, the binding means 14 consists of a lead gathering device 30 and a tape bonding device 40. The former device 30 grips the leads folded double and belonging to groups 1*a*, 1*b*, 1*c*, etc. Those leads of the harness 4 will thus form a compact bundle to be tied, while the harness is at the binding station and ready for the tying. The tape bonding device 40 will guide the tapes 5 so as to locate between them the gathered leads of the groups la, etc., before fusion bonding the tape portions not in contact with them. As a result, a ring 5' will appear around the leads thus tied.

Figure 6:
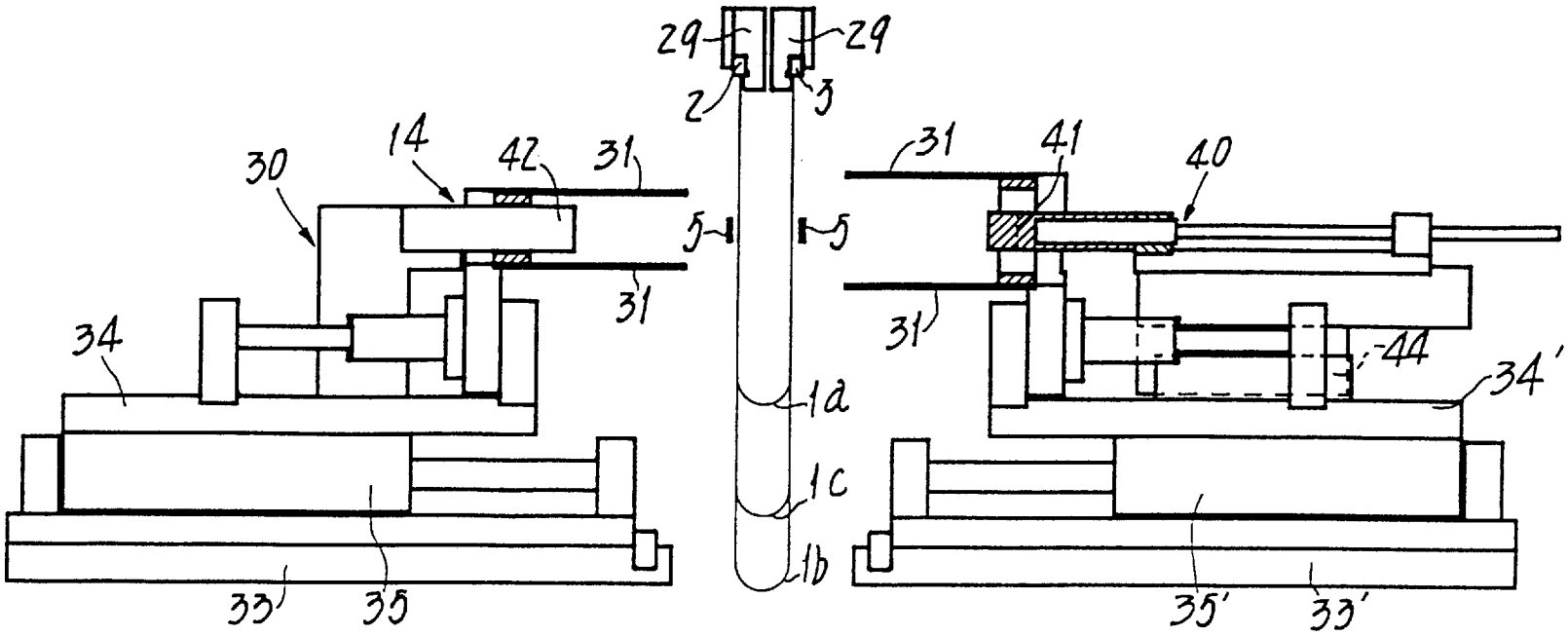
FIG. 6 is a front elevation of the principal part of the apparatus of FIG. 1, shown partly in vertical cross section.
Figure 7:
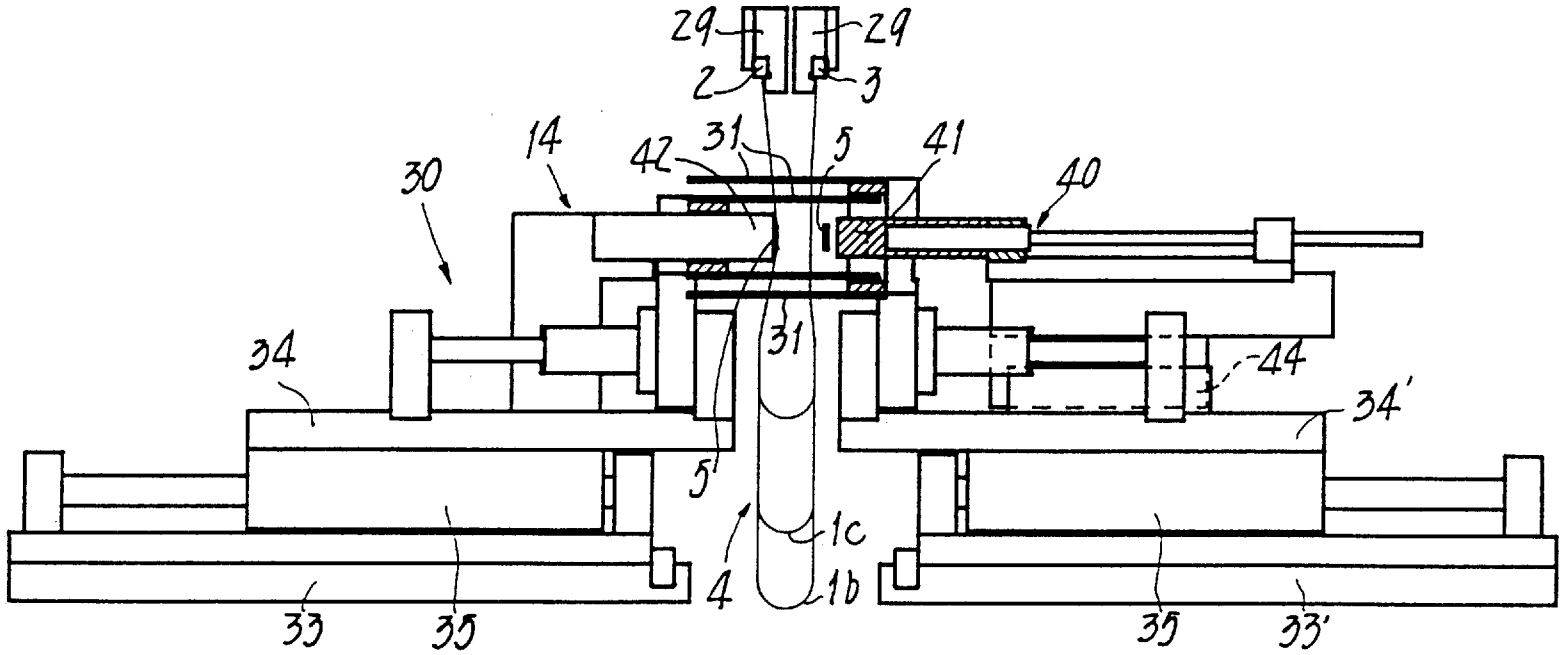
FIG. 7 is a front elevation similar to FIG. 6, but showing a pair of gathering plates moved to their working position.
Figure 8:
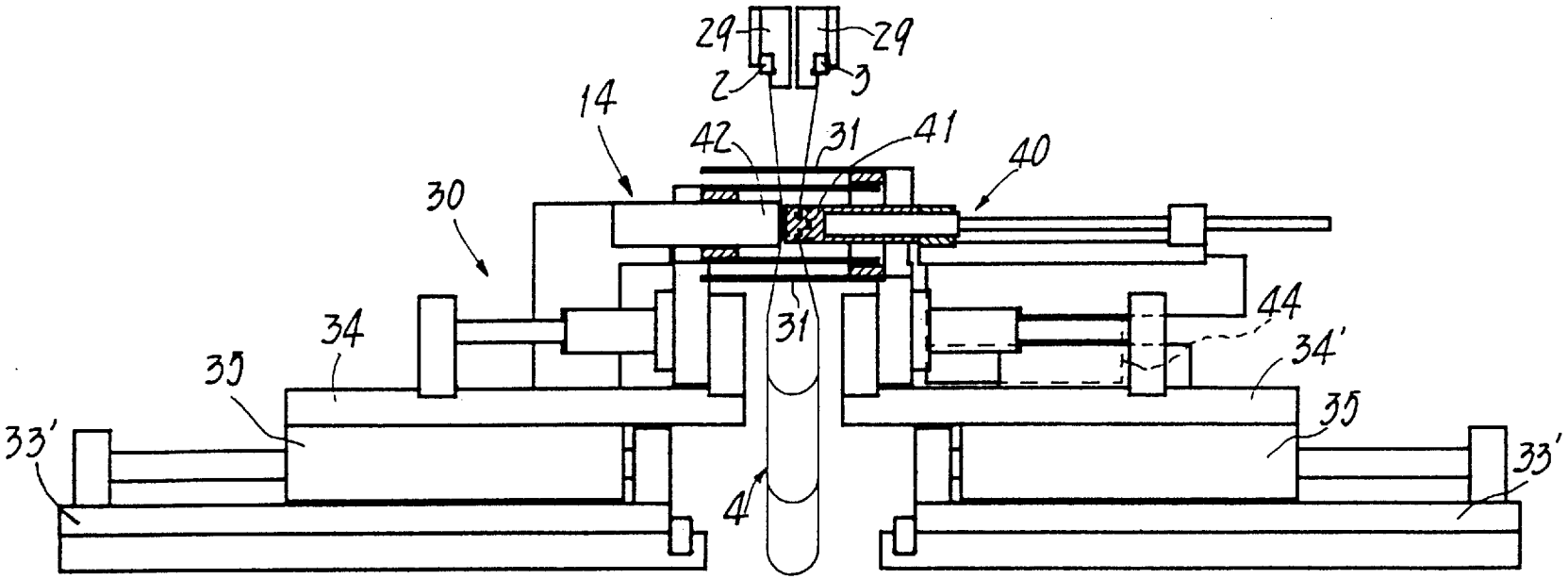
FIG. 8 is also a front elevation similar to FIG. 6, but showing a heating head in its activated state.
Figure 9:
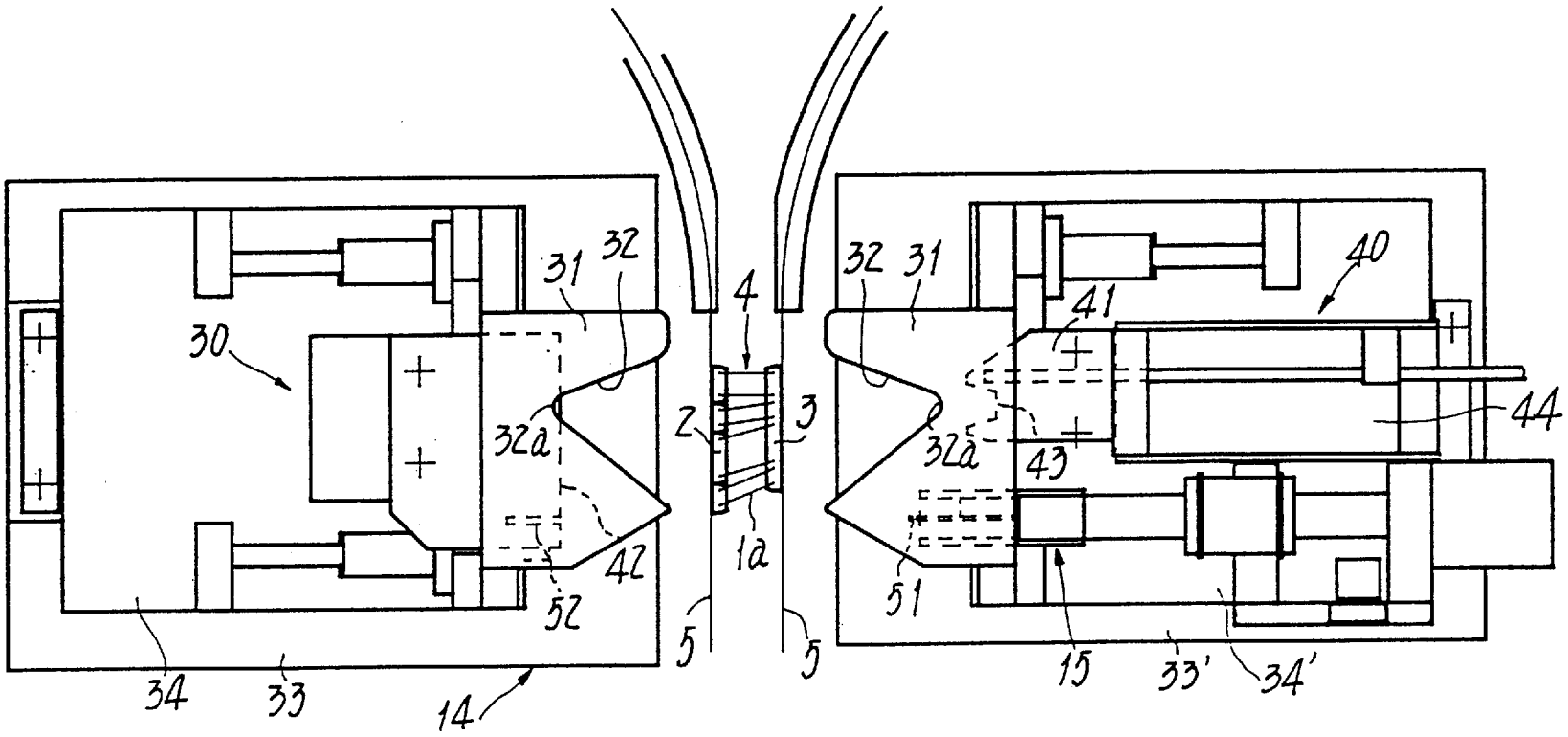
FIG. 9 is a plan view of the principal part of the apparatus of FIG. 1, shown at the first position.
Figure 10:
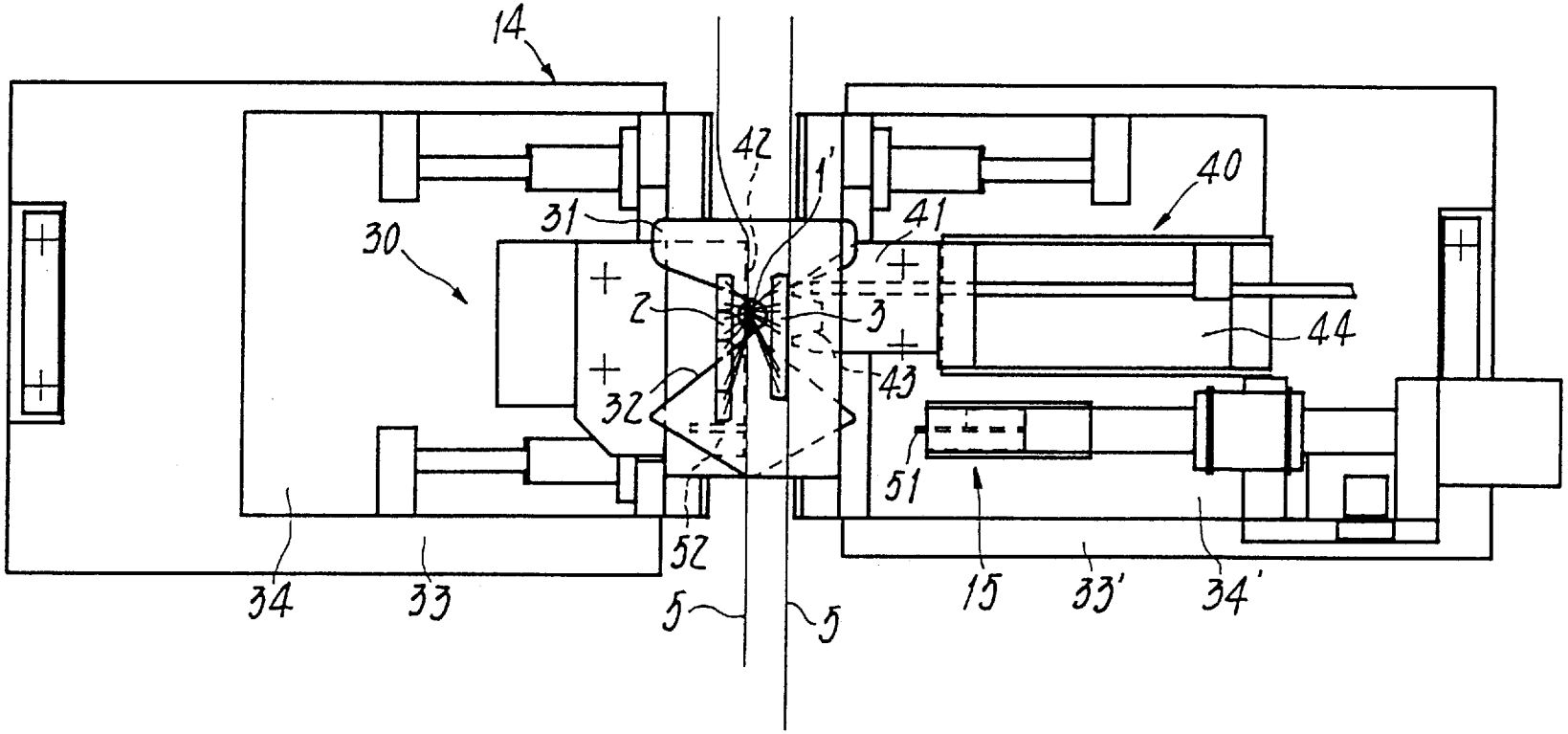
FIG. 10 is also a plan view of the principal part, shown at the second position.

FIG. 9 shows that the lead gathering device 30 comprises pairs of contraction plates 31 (formed as cooperative and symmetric counterparts) each having a V-shaped indent 32. These counterparts (31) facing one another extend transversely and perpendicular to the path for multiple harnesses 4. FIGS. 7 and 10 show that they are reversibly driven to overlap one another. When they overlap, the groups of leads 1*a*, 1*b*, 1*c*, etc. will be caught by the V-shaped indents 32 and converged between bottoms 32*a* thereof. As best seen in FIG. 6, two pairs of such counterparts functioning as the contraction plates 31 are arranged up and down and spaced an appropriate vertical distance. The left-hand counter-parts 31 belonging to different pairs are fixed on a traversing base 34, with right-hand ones being fixed on another traversing base 34'. The bases 34 and 34' are supported on left- and right-hand beds 33 and 33', respectively. As pneumatic cylinders 35 and 35' carry and hold the bases 34 and 34' close to each other, the leads or fine wires 1*a*, 1*b*, 1*c*, etc. will have upper and lower portions remaining converged until a subsequent retraction of said bases.

Figure 16:
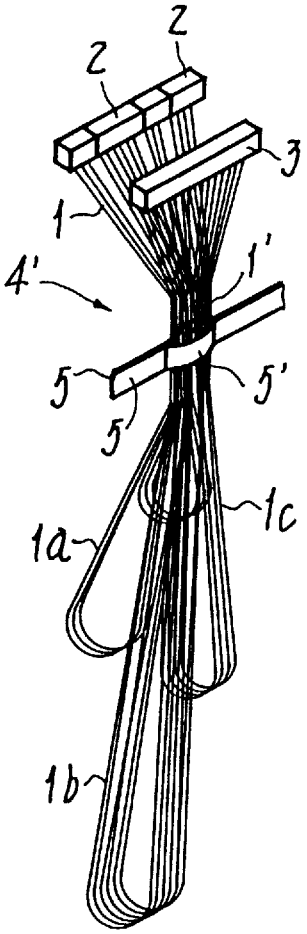
FIG. 16 is also a perspective view of the multiple harness whose leads have been tied up into a compact bundle.

On the other hand, the tape bonding device 40 comprises a thermal head 41 and an idle block 42 facing same, which are respectively mounted on the bases 34' and 34. A recess 43 is formed in a heating face of the thermal head 41, lest the converged leads 1'(see FIGS. 10–12) should interfere with it. The thermal head 41 and the idle block 42 are located intermediate the upper and lower pairs of contraction plates 31, wherein the head 41 is movable transversely relative to the base 34'. However, the idle block 42 fixed on the other base 34 is immovable relative thereto. As this base 34 approaches the leads 1*a*, etc. to take a position shown in FIGS. 7 and 10 causing them to converge, the end face of idle block 42 will bring one tape 5 into contact with the converged bundle 1' of those leads. The thermal head 41 just having come into contact with the other tape 5 at that instance will be further driven towards the idle block, until the pair of tapes grip the converged bundle. Portions of these tapes facing one another and located adjacent to the bundle but not in contact therewith will be pressed between the thermal head 41 and idle block 42, so as to be fusion bonded one to another. A ring 5' will thus be formed tightly and stably around the contracted leads 1' of harness 4 (see FIGS. 12 and 16). Thanks to this ring 5', the leads in the tied multiple harness 4' remain bundled until that ring is broken later by a user.

Figure 17:
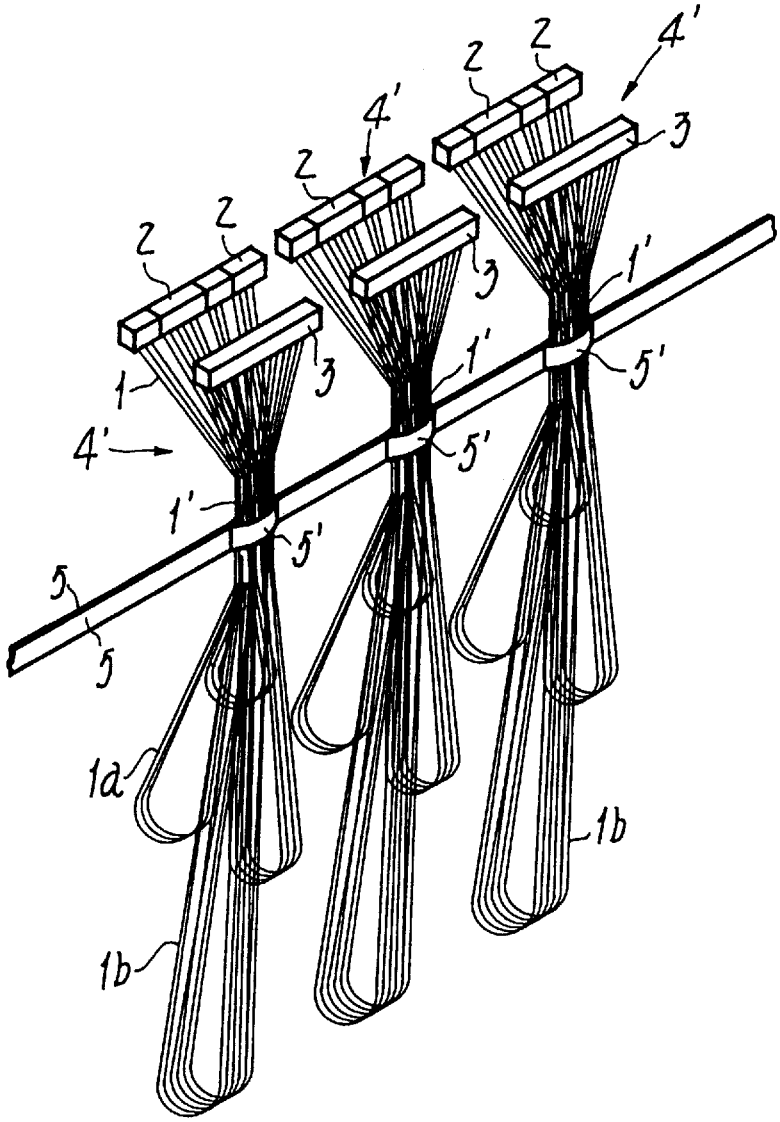
FIG. 17 is a perspective view of an array of multiple harnesses that are united side by side with a greater length of the binding material in another mode of the invention.

The pawl 28 shown in FIG. 1 will push outwardly the branching and common connectors 2 and 3 of the multiple harness 4' just tied. Thus, the preceding harnesses 4' are caused to advance forward along the guide rails 29 and discharged one by one. The cutting means 15 for severing the tape portions 5 from their remainders as described below may not be operated for each harness, or may be omitted, if so desired. In such a case, a number of the tied harnesses 4' remain connected to the others by the tapes, forming a chain-like elongate array as shown in FIG. 17.

Figure 11:
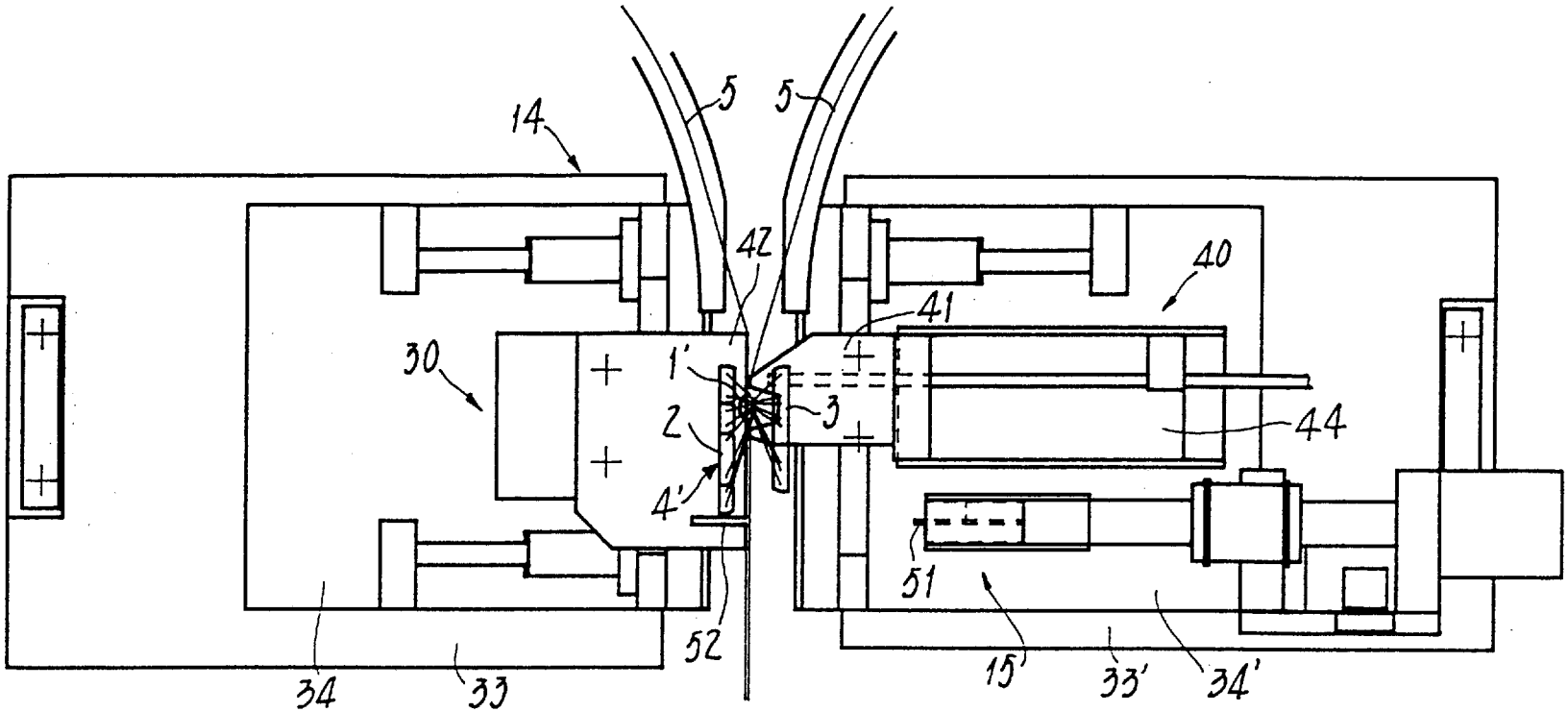
FIG. 11 is a plan view of a principal part of a further means for bonding a couple of tapes to each other around the harness and then severing the bonded tape portions from remainders, this means also included in the apparatus shown in FIG. 1.
Figure 12:
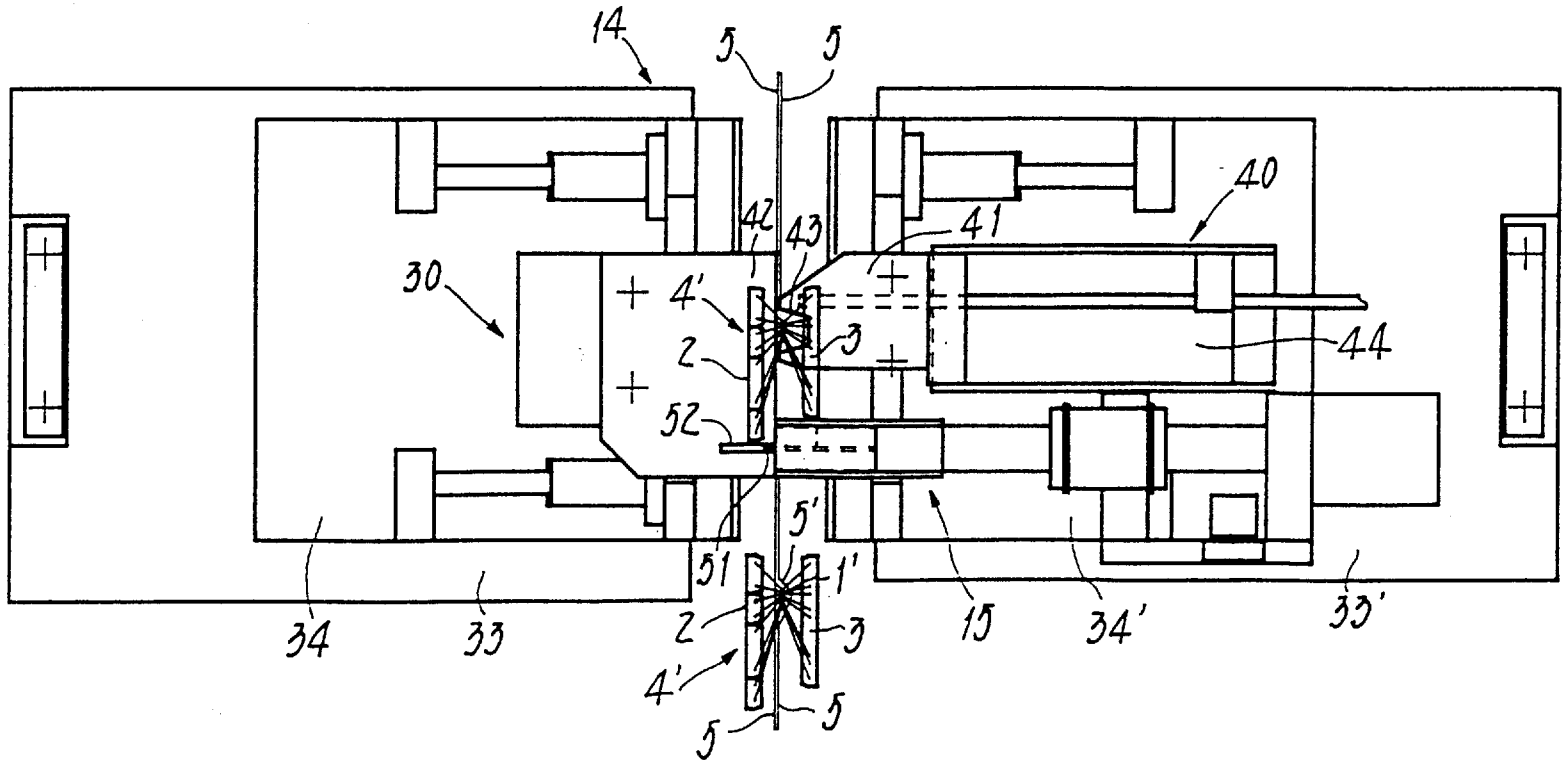
FIG. 12 is a plan view similar to FIG. 11, but showing the further means currently severing the tapes.

The cutting means 15 comprises a blade 51 disposed on one of the traversing bases 34', and at a position shown in FIGS. 11 and 12. The blade 51 lies in parallel to the thermal head 41 and traverses in a direction perpendicular to the path of harnesses. A slit 52 formed in the idle block 42 is designed to removably fit on an end portion of the blade. After being tied with the tape ring 5' at the binding station using the thermal head, the multiple harness 4' will advance a distance to stand still apart from the station as shown in FIG. 12. At this moment, the blade 51 will be driven to the left in the drawings. In this way, the tape portions 5 behind the tied harness are severed to separate one such harness shown in FIG. 16 from the other following harnesses. If, alternatively, the blade 51 is actuated when a predetermined number of tied harnesses 4' have transferred onto the guide rails 29, then a chain-like array thereof shown in FIG. 17 will be delivered from the apparatus.

Figure 13:
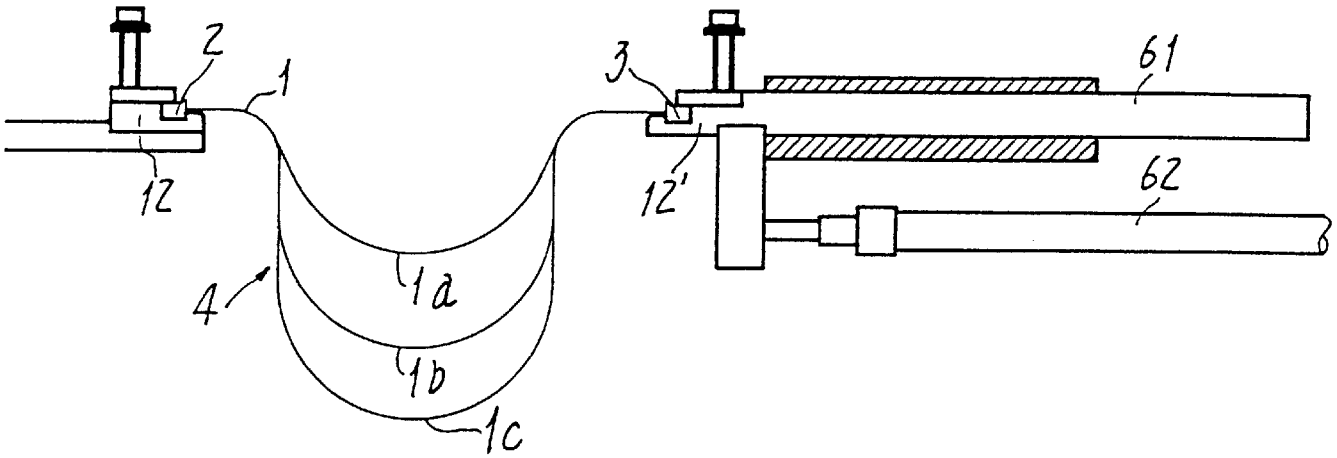
FIG. 13 is, a diagrammatic front elevation of a pair of supporters for connectors, the supporters being provided in another embodiment, wherein the upper part (a) shows the supporters held temporarily at a first position aligned with delivery rails extending from an automatic crimper (not shown) so as to receive connectors there-from, and the lower part (b) shows the supporters being driven towards each other to take a second position.
Figure 13:
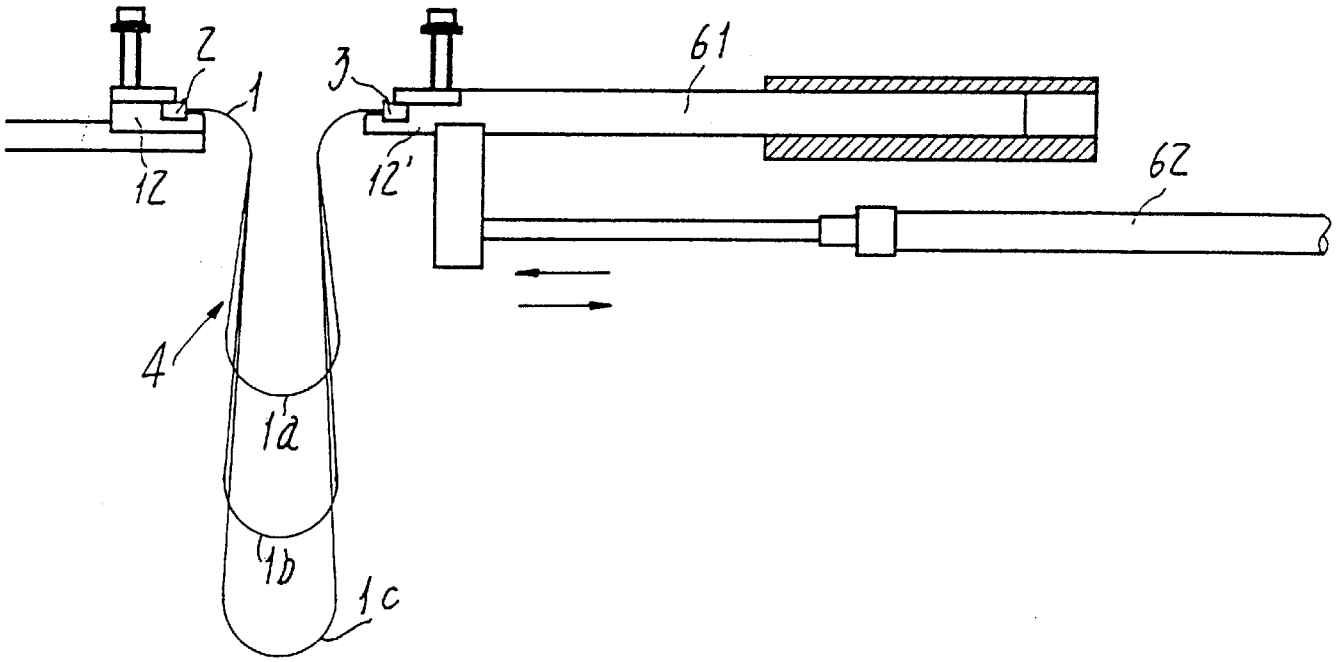
Figure 14:
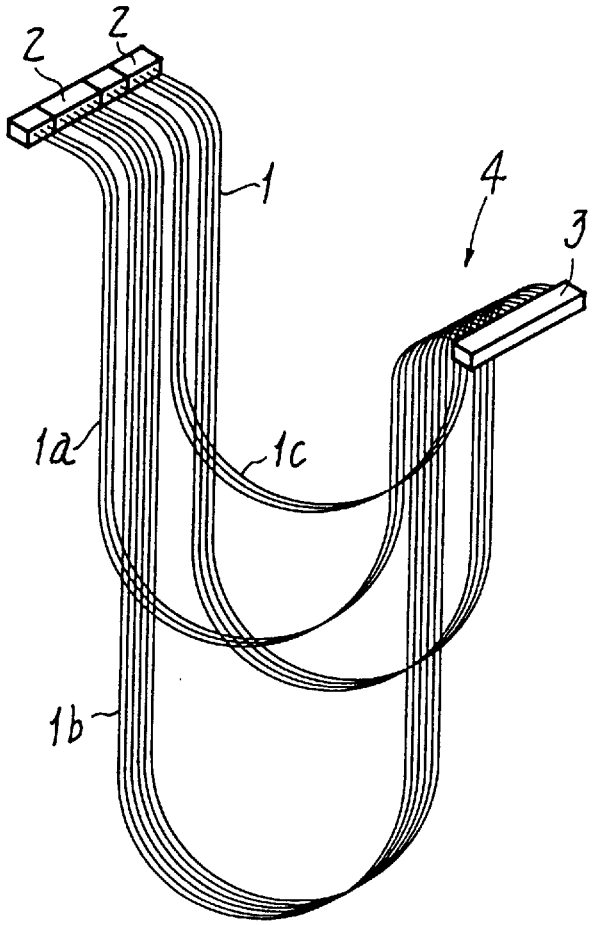
FIG. 14 is a perspective view of the multiple harness being discharged from the automatic crimper along the delivery rails (not shown)

FIG. 13 illustrates a modification of the means 13 for driving the supporters. One of the supporters 12 stands still. The other supporter 12' does not swing but merely moves in a translational manner and in a horizontal direction, because it is formed integral with the end of a traversing rod 61. A pneumatic cylinder 62 drives this rod 61 to reciprocate horizontally between a first position shown at part (a) and a second position shown at part (b) of FIG. 13. At the first position, both the supporters 12 and 12' are located close to and aligned with the delivery rails 7 so as to receive the connectors. As the other supporter 12' moves towards the one supporter 12 to take the second position, the groups of leads 1*a*, 1*b*, 1*c*, etc. will be folded double. The driving means may further be modified such that both the supporters 12 and 12' are driven in opposite directions.

If adhesive tapes are used in place of the fusion bondable tapes 5 in the described embodiment, then a simple pressing head will substitute for the thermal head 41.

In summary, the multiple harness having the branching and common connectors have its leads crimped thereto, folded double, converged and then tied into a compact bundle, such that the connectors are kept close to each other. These harnesses are protected from tangling, whereby the handling thereof in use or post-treatments can be done without any trouble. The binding material can be readily broken so that the leads in each harness are made free, thus excluding any problem when connecting it to any desired electronic instruments or devices.

The method and the apparatus proposed herein and enabling an automatic and efficient tying of the multiple harnesses may be employed in connection with the conventional automatic crimper in order to operate same in a full automatic and unattended manner.

What is claimed is:

1. An apparatus for tying a multiple harness delivered from an automatic crimper in which a plurality of leads are divided into at least two groups, then one ends of the leads of the groups are crimped and fixed to respective branching connectors, the other ends of all the leads are crimped and fixed to a common connector to thereby form a multiple harness, and finally the branching connectors are driven along one of delivery rails so as to travel in parallel and in unison with the common connector which is traveling along the other delivery rail paired with the one rail and disposed in the automatic crimper, so that the harness is discharged from the crimper, the apparatus comprising:

a pair of supporters disposed adjacent to ends of the delivery rails so as to respectively support the branching connectors and the common connector of each multiple harness;

a driving means for causing the supporters to reciprocate between a first position aligned with the delivery rails and receiving therefrom the branching and the common connectors attached to the harness and a second position where the supporters are held close to each other so that the leads are folded double;

a binding means for gathering and tying the folded leads into a bundle with portions of an easily breakable and elongate binding material; and a cutting means for severing the portions from a remainder of the binding material.

2. An apparatus as set forth in claim 1, wherein the driving means causes the supporters to swing an angle of about 90° degrees towards and away from each other.

3. An apparatus as set forth in claim 1, wherein the driving means causes the supporters to move in a horizontal direction towards and away from each other.

4. An apparatus as set forth in claims 1, 2 or 3, wherein the binding means consists of a lead gathering device and a tape bonding device, wherein the lead gathering device is to grip the leads folded double and belonging to the groups so that the leads form a compact bundle ready for the tying, and wherein the tape bonding device is to guide tapes as the binding material so as to locate between portions thereof the gathered leads before fusion bonding or adhesive bonding further portions of the tapes to each other, with the further portions being not in contact with the leads.

* * * * *